US005107820A

United States Patent [19]

Salansky

[11] Patent Number: 5,107,820

[45] Date of Patent: Apr. 28, 1992

[54] BALL-THROWING DEVICE FOR TENNIS BALLS

[76] Inventor: Werner Salansky, Reinlgasse 5-9, A-1140 Vienna, Austria

[21] Appl. No.: 490,569

[22] PCT Filed: Aug. 28, 1989

[86] PCT No.: PCT/AT89/00075

§ 371 Date: May 16, 1990

§ 102(e) Date: May 16, 1990

[87] PCT Pub. No.: WO90/01975

PCT Pub. Date: Mar. 8, 1990

[30] Foreign Application Priority Data

Aug. 29, 1988 [AT] Austria ..... 2111/88

[51] Int. Cl.[5] ..... A63B 69/40

[52] U.S. Cl. ..... 124/78; 273/29 A; 124/81; 124/48; 124/50

[58] Field of Search ..... 124/78, 32, 45, 81, 124/48, 49, 50; 273/29 A

[56] References Cited

U.S. PATENT DOCUMENTS

| | | | |
|---|---|---|---|
| 3,777,732 | 12/1973 | Holloway et al. | 124/78 |
| 3,785,358 | 1/1974 | D'Angelo et al. | 124/78 |
| 3,794,011 | 2/1974 | Newgarden, Jr. | 124/78 |
| 3,913,552 | 10/1975 | Yarur et al. | 124/78 |
| 4,004,567 | 1/1977 | Henderson | 124/32 X |
| 4,086,903 | 5/1978 | Scott | 124/78 |
| 4,185,824 | 1/1980 | Natwick | 124/73 X |
| 4,269,163 | 5/1981 | Feith | 124/77 |
| 4,280,697 | 7/1981 | Yuasa | 273/29 A |
| 4,563,999 | 1/1986 | Miehlich | 124/78 X |
| 4,583,514 | 4/1986 | Nozato | 124/78 |
| 4,834,060 | 5/1989 | Greene | 124/78 |
| 4,995,374 | 2/1991 | Black | 124/32 X |

FOREIGN PATENT DOCUMENTS

| | | | |
|---|---|---|---|
| 2262880 | 6/1974 | Fed. Rep. of Germany | 124/78 |
| 2945588 | 5/1981 | Fed. Rep. of Germany | 124/78 |
| 0046635 | 4/1979 | Japan | 124/32 |
| 8200116 | 8/1983 | Netherlands | 124/78 |
| 8103432 | 12/1981 | PCT Int'l Appl. | 124/78 |
| 0138002 | 10/1979 | U.S.S.R. | 124/32 |

*Primary Examiner*—Randolph A. Reese
*Assistant Examiner*—Jeffrey L. Thompson
*Attorney, Agent, or Firm*—Wenderoth, Lind & Ponack

[57] ABSTRACT

A ball delivery apparatus, in particular for tennis balls, includes a ball magazine, a ball firing system, and a feed system that moves balls from the ball magazine one by one to the ball firing system. The ball firing system fires each ball in accordance with a preprogrammed firing setting that in each instance determines the speed, spin, and/or direction of each ball. A variable feed sequence frequency of the feed system is controlled as a function of the firing settings of the ball firing system. A time interval scale for establishing the movement of the next ball through the feed system is associated with each firing setting accepted by the ball firing system for firing a ball. The intervals between the balls can be matched to the particular ball characteristics.

9 Claims, 2 Drawing Sheets

FIG.2
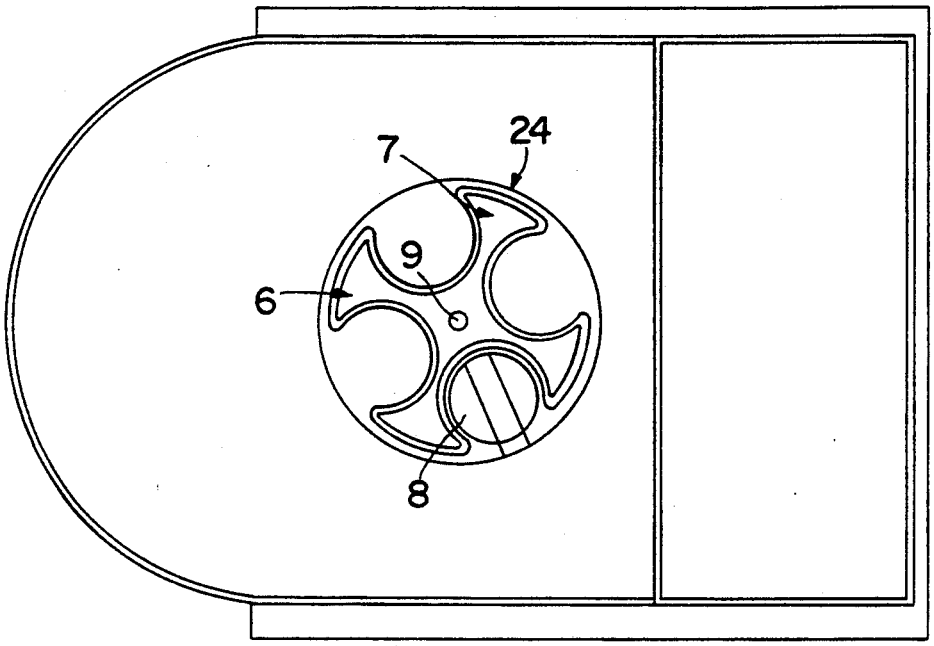
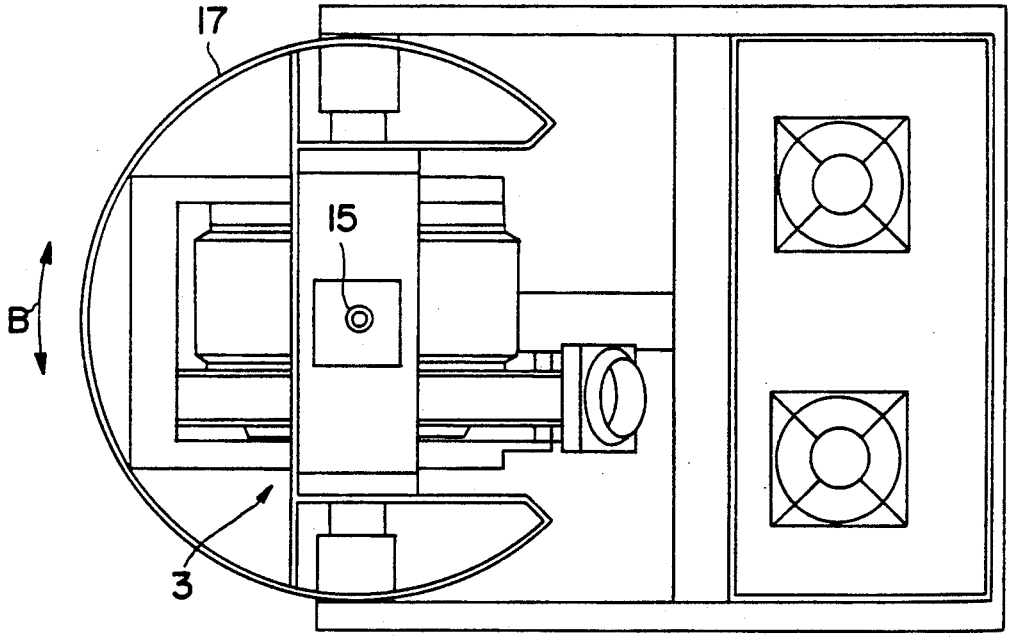
FIG.3

BALL-THROWING DEVICE FOR TENNIS BALLS

BACKGROUND OF THE INVENTION

The present invention relates to a ball delivery apparatus, in particular for tennis balls, including a ball magazine, a ball firing system, and a feed system that removes the balls from the ball magazine one at a time and delivers them to the ball firing system, the ball firing system then fires the balls according to a pre-programmed firing setting that determines the speed, spin, and/or direction of each ball.

In known ball delivery systems, generally speaking horizontal traverse is effected automatically in order that the balls can be delivered to the player in various ways.

In order to make the game more realistic, it is known from the prior art that specific delivery settings can be programmed into the ball firing system and then called up. In general, such a delivery setting defines the speed, spin, and direction of the balls that are fired. In these known ball delivery apparatuses, the feed sequence frequency, defined so as to be regular by the feed system, and the associated frequency with which the balls are fired, which is also regular, is a disadvantage. In order to make play faster or slower, it is known that this feed frequency can be regulated. However, play can become monotonous because of the pauses between balls that are of the same length once the rate of play has been selected, and this is hardly in keeping with an actual game.

SUMMARY OF THE INVENTION

It is the object of the present invention to create a ball delivery apparatus of the type described above, with which play that is more variable and realistic can be effected.

According to the present invention this has been achieved in that the variable feed sequence frequency of the feed system is controlled as a function of the firing setting of the ball firing system, a time interval scale for establishing the feed of the next ball by the feed system being associated with each of the firing settings accepted by the ball firing system for firing a ball.

The firing setting determined by the ball firing system thus always establishes the time interval after which the next ball will be moved from the magazine to the feed system.

Thus, it is possible to match the pauses between the balls that are fired to the trajectory characteristics established by the firing system so that they are in keeping with an actual game of tennis. As an example, the feed sequence frequency (and thus, of course, the firing sequence frequency) can be so selected that the pause after a low, fast ball is brief, and longer after a high ball. The apparatus according to the present invention gives the player a more pronounced feeling that he is playing not against a machine that delivers balls with a regular firing rhythm, but against a live opponent.

The fact that the next pause is always established by a firing setting is an advantage mainly if the sequence of the firing settings is produced by a random generator for then, despite the random sequence of firing settings, it is always ensured that the intervals between balls remain realistic because of the "ball and pause" units that always remain constant. Even if the programming of the sequence of firing settings is undertaken arbitrarily by the user, the intervals between balls will remain realistic.

By means of a suitable control system, the time interval scale discussed above always establishes for each firing setting when the feed system delivers the next ball. According to a preferred embodiment of the present invention, provision is made for the fact that an adjusting system is provided by which all the time intervals between the balls that are delivered, established in combination with the firing settings of the firing system, can be increased or decreased jointly by an adjusting factor. This means that the firing times between balls can be varied proportionally, i.e., the time intervals that are programmed differently to the individual firing settings in the form of time interval scales are all increased or decreased by the same factor. This means that play remains the same as far as its 'feel' is concerned; it will simply be faster or slower. The overall speed of play can more favourably be varied by the player by means of a remote control.

The beginning of each time interval, after which the feed system moves the next ball, can be established through a ball transit sensor in the feed track that leads from the ball magazine to the delivery system. In principle, it would also be possible to involve, for example, specific positions of a feed member at the base of the ball magazine to determine the beginning of such time intervals. However, the ball transit sensor makes it possible to determine the true passage of a ball precisely, and thereby makes a very precise 'ball-related' functional sequence possible. If, for example, despite the proper setting of the ball feed system, a ball is missed or delayed, this does not interfere with the sequence since, for example, subsequent switching of the firing system to a subsequent firing setting only takes place after a specific time after the actual passage of a ball; the feed control also takes the actual passage of a ball as the start signal. The sensor can also be used as a shut-off sensor that switches the apparatus off automatically after a specified time if the balls fail to appear.

BRIEF DESCRIPTION OF THE DRAWINGS

An embodiment of the present invention is described in greater detail below with reference to the accompanying drawings, wherein:

FIG. 2 is a plan view of the ball delivery system according to the present invention; and FIG. 3 is an illustration of the ball system according to the present invention as viewed from below.

DETAILED DESCRIPTION OF THE INVENTION

Figure 1:
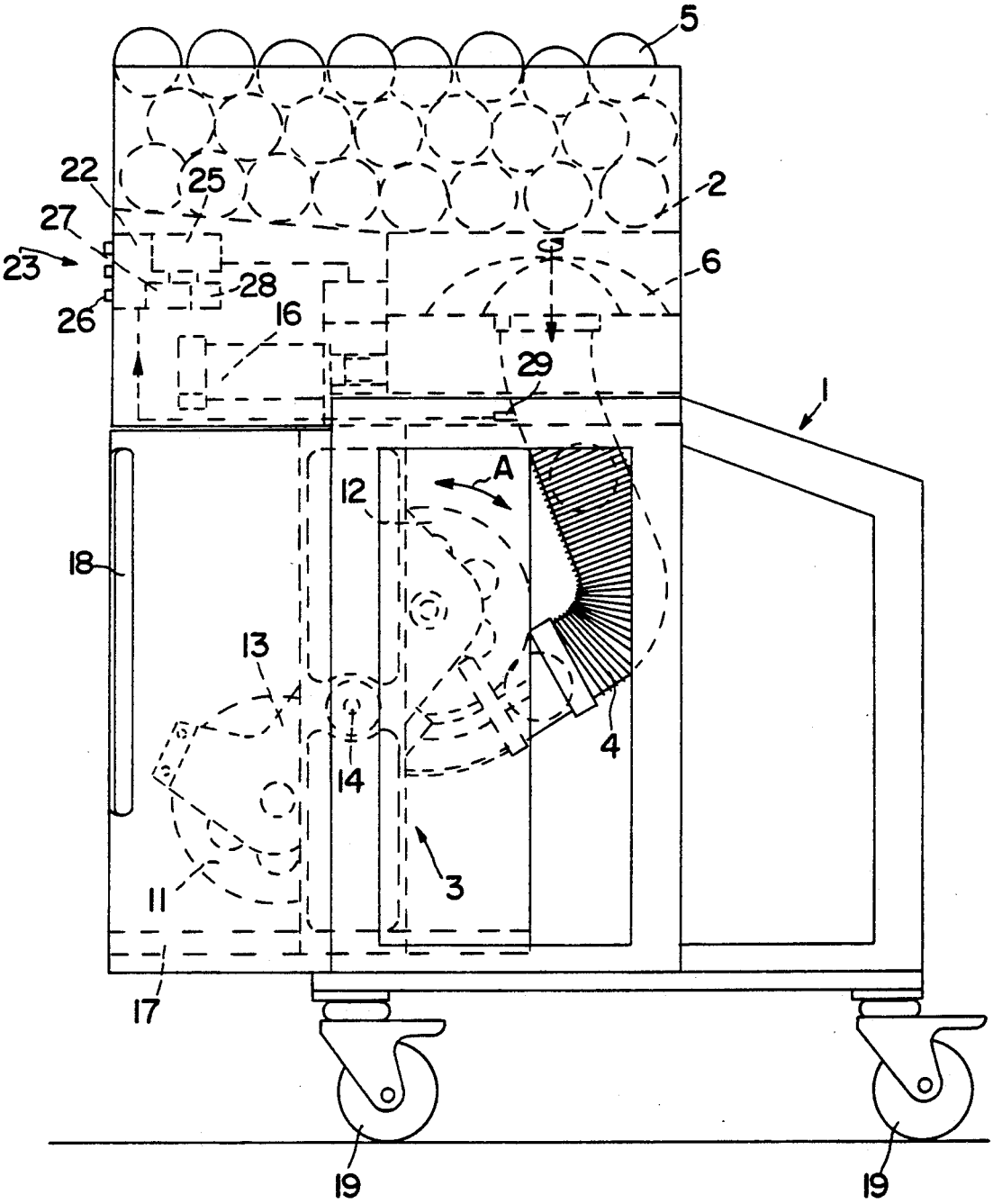
FIG. 1 is a side view, in partial cross-section, of a ball delivery system according to the present invention.

As can be seen from the drawings, the ball delivery system according to the present invention comprises a casing 1 that incorporates at the top thereof a ball magazine 2 and at a lower position thereof a ball firing system 3.

The ball firing system 3 is connected to the ball magazine 2 through a hose-like feed line that is in the form of a wire coil 4.

The movement of individual balls 5 from the ball magazine 2 to the ball firing system 3 is controlled in the usual manner by means of a driver 6 that picks up the balls 5 between arms 7 and moves them one at a time to an inlet opening 8 of the hose-like wire coil 4. The driver 6 is driven by an electric motor. The driver 6 is supported on a shaft 9.

The two principal parts of the firing system 3 are two rollers 11 and 12. The two rollers 11 and 12 are installed on a rocker 13. The angle of inclination of the rocker 13 in the vertical plane, i.e., its rotation in the direction indicated by the arrow A in FIG. 1, is controlled by an electric motor.

The rocker 13 is so supported at bearings 14 that it can pivot about a vertical shaft 15. This makes it possible to achieve a very large horizontal traverse of up to 120°. The pivoting movement is not obstructed by the wire coil 4 that forms the feed track for the balls 5.

Rotation about the shaft 15 in the horizontal plane, i.e., in the direction indicated by the arrow B in FIG. 3, is effected by means of an electric motor 16.

The entire ball firing system 3 is surrounded by a cylindrical casing 17 that has therethrough an opening 18 for the passage of the balls 5.

The casing 1 is fitted with casters 19, but these serve only to move the ball delivery machine. The casing 1 remains stationary when the delivery mechanism 3 is traversing. Only the parts that are supported by the shaft 15 move.

An essential element of the feed system is the rotatably supported feed member or driver 6. In order to improve the feed, the driver 6 has a friction lining 24 on its outer surface, and this ensures that the tennis balls that are against it are moved effectively.

The position of the rocker 13, the angle of rotation about the shaft 15 and the speed of the two rollers 11, 12, together define the firing setting of the ball firing system 3 and thus the flight characteristics of the balls that are fired.

The entire playing sequence, i.e., the firing setting of the ball firing system 3 and the feed member 6 (for reasons of clarity, the control lines that lead to the ball delivery system have been omitted) are controlled by an electronic control system that bears the collective number 22. Data that relate to firing settings are stored in the storage device 25, the contents of which can be changed by the user through a keyboard 23 or a remote control system, each data set corresponding to a specific firing setting or set of ball flight characteristics. Programming these firing settings can be managed in a user friendly environment in that it is not the roller speeds and roller positions that are input direct, but rather the desired ball speed, direction, spin, and so on, that are required. The data that has been input and stored can be read off a display.

The sequence of the now pre-programmed firing settings can be established by using a sequence control system 27 that can be programmed by the user. When this is done, during training, specific balls (firing settings) can be demanded a number of times in succession. In addition, it is also possible to establish the sequence of firing settings using a random generator 28.

It is important for the present invention that the feed sequence frequency with which the feed member 6 moves the balls 5 from the magazine 2 of the ball firing system 3 is not essentially constant, as has been the case heretofore, but can be variously controlled as a function of the ball firing settings of the ball firing system 3. By this means, it is possible to make play realistic, because the pauses between the balls can be kept in accordance with the type of balls played, as is the case in an actual game.

In this regard, it is especially favourable that a time interval scale for establishing the delivery of the next ball by the delivery system is associated with each of the firing settings accepted by the ball firing system for firing a ball. The beginning of the time interval is best determined by a ball transit sensor 29 in the wire coil 4, which picks up the actual passage of a ball. After a time interval that is a function of the firing setting of the ball that has been fired and which has been preprogrammed by the user in the memory 25, the next ball is delivered under the control of the electronic control system. The driver 6 can rotate continuously, with its speed being increased or decreased according to long or short time intervals. Because of the fact that a particular pause is associated with each firing setting, after which the next ball is delivered, play remains realistic even when the sequence of the pre-programmed firing settings is determined by a random generator.

The time intervals for the delivery of the next ball, which are associated with each preprogrammed firing setting, can be stored in the memory 25 as relative time interval scales, the actual time intervals then resulting in each instance from the time interval scale multiplied by a factor. By changing this common factor by way of an adjusting system 26 or a remote control system, the entire game can be made faster or slower without changing any of the actual game characteristics. The relation of the time intervals, programmed as a function of the firing setting of the firing system, remains available when changing this factor.

An electronic monitoring unit that is connected to the ball transit sensor 29 can monitor the sensor signals and ensure that if a sensor signal does not appear within a certain time, the ball delivery system and/or the feed system will be shut down.

The present invention is not confined to the embodiments shown and described herein. In particular, the concrete realisation of the feed system 6 and the ball delivery system can be varied widely within the context of the present invention.

I claim:

1. A ball delivery apparatus, particularly for tennis balls, comprising:

a ball magazine for storing a plurality of balls to be delivered;

a ball firing system for firing balls one at a time in preprogrammed firing settings that determine for each ball firing parameters such as speed, spin and direction;

A feed system for feeding balls one-by-one from said magazine to said firing system; and means for controlling the operation of said feed system to feed balls from said magazine to said firing system at a sequence that is variable as a function of said firing settings of said firing system, said controlling means including means for determining a time interval for operating said feed system to feed a next ball from said magazine to said firing system dependent on a firing setting assumed by said firing system for firing a current ball.

2. An apparatus as claimed in claim 1, further comprising memory means, the contents of which are selectively changeable by a user, for storing data records relating to firing settings controlling operation of said firing system, and for storing data records relating to associated time intervals for operation of said feed system.

3. An apparatus as claimed in claim 2, further comprising a sequence control system, programmable by the user, for establishing a sequence of preprogrammed firing settings of said firing system, wherein each firing setting regardles of its position in said sequence maintains a respective said time interval determining the feeding of a following ball.

4. An apparatus as claimed in claim 2, further comprising random generator means for establishing a random order sequence of preprogrammed firing settings of said firing system, wherein each firing setting in said random order sequence maintains a respective said time interval determining the feeding of a following ball.

5. An apparatus as claimed in claim 1, wherein said controlling means further includes adjusting means for adjusting all time intervals between feeding of the balls by said feed system such that all said time intervals are increased or decreased by the same adjustable factor.

6. An apparatus as claimed in claim 1, wherein said feed system includes a feed track extending from said magazine to said firing system, and further comprising a ball transit sensor for detecting the passage of a ball in said feed track and for generating a signal representative thereof, and means for, in the absence of said signal for a predetermined period of time, stopping operation of said feed system and said firing system.

7. An apparatus as claimed in claim 6, wherein said sensor establishes the beginning of each said time interval.

8. An appartus as claimed in claim 6, wherein said feed track comprises a flexible wire coil.

9. An apparatus as claimed in claim 1, wherein said feed system includes a rotatable member having a plurality of pick-up compartments for receiving individual balls and having a surface with a friction lining.

* * * * *